US011344095B2

(12) United States Patent
Richmond et al.

(10) Patent No.: US 11,344,095 B2
(45) Date of Patent: May 31, 2022

(54) SAFELY SINGLE-HANDED HAIR CURLER

(71) Applicant: TRADE BOX, LLC, Culver City, CA (US)

(72) Inventors: David Richmond, Culver City, CA (US); Howard Richmond, Los Angeles, CA (US)

(73) Assignee: Trade Box, Inc., Culver City, CA (US)

( * ) Notice: Subject to any disclaimer, the term of this patent is extended or adjusted under 35 U.S.C. 154(b) by 351 days.

(21) Appl. No.: 15/411,865

(22) Filed: Jan. 20, 2017

(65) Prior Publication Data

US 2017/0208915 A1 Jul. 27, 2017

Related U.S. Application Data

(60) Provisional application No. 62/281,457, filed on Jan. 21, 2016.

(51) Int. Cl.
*A45D 20/50* (2006.01)
*A45D 20/10* (2006.01)
(Continued)

(52) U.S. Cl.
CPC ..... *A45D 20/50* (2013.01); *A45D 2/00* (2013.01); *A45D 7/02* (2013.01); *A45D 20/10* (2013.01);
(Continued)

(58) Field of Classification Search
CPC . A45D 2/00; A45D 2/02; A45D 20/08; A45D 20/48; A45D 20/50; A45D 20/52;
(Continued)

(56) References Cited

U.S. PATENT DOCUMENTS 1,221,447 A 4/1917 Henderson
1,436,957 A 11/1922 Harvey
(Continued)

FOREIGN PATENT DOCUMENTS

FR 2427805 A1 1/1980
JP 2004089266 A 3/2004
JP 2010252991 A 11/2010

OTHER PUBLICATIONS

Web pages printout from http://www.Amazon.com for "Heat Straight Ultimate Straightening Brush Model No. B950," dated Jan. 20, 2016 (5 pages).

(Continued)

*Primary Examiner* — Edward Moran
(74) *Attorney, Agent, or Firm* — Smyrski Law Group A P.C.

(57) ABSTRACT

A hair styling device comprises a base having a rear handle portion and a forward styling portion, the forward styling portion comprising a plurality of projections, the plurality of projections comprising one or more of the following: bristles, comb teeth or spaced apart, plates. The device comprises a retainer arm opposed to the base, and pivotally connected to the base so that the retainer arm can pivot from an open position to receive hair and a closed position for retaining hair in the plurality of projections. The forward section of the retainer arm does not have projections and has sufficient open space that at least 50% of the hair being styled is visible to a user.

19 Claims, 10 Drawing Sheets

(51) Int. Cl.

| | |
|---|---|
| ***A45D 20/12*** | (2006.01) |
| ***A45D 2/00*** | (2006.01) |
| ***A45D 7/02*** | (2006.01) |
| ***A46B 9/02*** | (2006.01) |
| ***A46B 15/00*** | (2006.01) |
| ***A46B 17/00*** | (2006.01) |

(52) U.S. Cl.
CPC ..... *A45D 20/12* (2013.01); *A46B 9/023* (2013.01); *A46B 15/003* (2013.01); *A46B 17/00* (2013.01); *A45D 2002/003* (2013.01)

(58) Field of Classification Search
CPC ..... A45D 20/525; A46B 2200/104; A46B 15/003; A46B 9/08; A46B 9/10; A46B 9/12; A46B 11/08
See application file for complete search history.

(56) References Cited

U.S. PATENT DOCUMENTS 1,591,065 A * 7/1926 Wertheim ..... A45D 1/04 132/224
2,144,408 A * 1/1939 Holmes ..... A46B 9/10 601/141
2,446,236 A * 8/1948 Morris ..... A45D 20/48 15/160
2,895,487 A * 7/1959 Hazzard ..... A46B 9/023 132/110
3,818,916 A * 6/1974 Meyer ..... A45D 24/04 132/313
3,935,423 A * 1/1976 Pucci ..... A45D 1/04 219/225
3,970,093 A * 7/1976 Lardenois ..... A45D 20/50 132/271
D264,400 S * 5/1982 Arnold ..... D4/122
4,593,708 A 6/1986 Goeller et al.
4,625,738 A 12/1986 Skovdal et al.
6,047,707 A 4/2000 Johnson
8,220,100 B2 7/2012 Diamond
D846,885 S * 4/2019 Khoun ..... D4/117
2005/0178400 A1* 8/2005 Fung ..... A45D 1/16 132/228
2005/0210614 A1* 9/2005 Chang ..... A61H 7/003 15/186
2007/0169787 A1* 7/2007 Kim ..... A45D 20/525 132/241
2007/0174984 A1* 8/2007 Diamond ..... A46B 5/0012 15/106
2007/0199574 A1* 8/2007 Ragosta ..... A45D 1/04 132/238
2015/0101139 A1* 4/2015 Guy-Rabi ..... A46B 9/06 15/207.2
2017/0112271 A1* 4/2017 Gulamani ..... A46B 7/044
2018/0125223 A1* 5/2018 Exley ..... A46B 15/003

OTHER PUBLICATIONS

Web pages printout from http://www.aliexpress.com for "Professional Hair Straighten Comb Hair Dressing Tool Duplex Brush Hair Straightening Combs Care Clamp of DIY Hair-Styling Tools," dated Jan. 20, 2016, (6 pages).

* cited by examiner

SAFELY SINGLE-HANDED HAIR CURLER

CROSS-REFERENCE TO RELATED APPLICATIONS

This application claims the benefit of U.S. Provisional Patent Application No. 62/281,457 titled "Heated Hair Curling Device With Retainer Arm," filed. Jan. 21, 2016, the contents of which are incorporated herein by reference in their entirety.

Heated hair brushes are known wherein there are a plurality of projecting bristle like structures that are heated. Similarly, heated combs are known where there is a plurality of heated teeth like projections.

A challenge with some of these devices is a user, to get the full effect of the heated projections, needs to use a hand to hold the hair in place as is being styled by the device. Thus, the device requires two hands, with one hand at risk of contact with heated projections. Moreover, devices that try to be single handed sometimes block the user's ability to see the styling which can lead to overheating hair.

Thus there is a need for hair styling devices that overcome the deficiencies of these existing devices.

SUMMARY

The present invention is directed to a hair styling device that solves this need. The device comprises a brush or comb with a plurality of projections such as bristles or comb teeth or plates, the brush or comb having a pivot end section. The projections can be heated.

A retainer, also referred to as a tensioner, is pivotably connected to the pivot end section of the brush or comb so that the retainer can pivot from an open position to receive hair and a closed position for retaining hair in the brush or comb. The retainer does not have bristles or teeth and has sufficient open space that more than half, and preferably substantially all, of the hair being styled in the brush or comb is visible to a user so that a user can see the user's hair while styling to optimize styling and not overheat hair.

In one embodiment of the present invention, there is provided a hair styling device comprising: a) a base comprising a rear handle portion and a forward styling portion, the forward styling portion comprising a plurality of projections for hair styling; and b) a retainer arm comprising a rear handle portion and a forward section, the retainer arm being opposed to the base, wherein the rear handle portion of the retainer arm is pivotally connected to the rear handle portion of the base so that the retainer arm can pivot from an open position for the plurality of projections to receive hair and a closed position for retaining hair in the plurality of projections, the forward section of the retainer arm not having projections and having sufficient open space that at least 50% of the hair being styled in the plurality of projections is visible to a user. In one embodiment, the projections are heated. In another embodiment, the hair styling device further comprises: a) a plurality of holes disposed in the forward styling portion of the base, wherein the plurality of holes are dispersed throughout the plurality of projections; b) one or more blowers for blowing air through the plurality of holes; c) one or more motors for powering the one or more blowers; and d) one or more heaters for heating air blown by the one or more blowers. In one embodiment, the forward section of the retainer arm has sufficient open space that substantially all of the hair being styled is visible to the user. In another embodiment, the forward section of the retainer arm comprises mesh. In another embodiment, the forward section of the retainer arm is a loop and the loop in the closed position is circumferentially around substantially all of the projections.

In another embodiment of the present invention, there is provided a method of using a hair styling device, the method comprising the steps of: a) holding a hair styling device, the hair styling device comprising: i) a base comprising a rear handle portion and a forward styling portion, the forward styling portion comprising a plurality of projections for hair styling; and ii) a retainer arm comprising a rear handle portion and a forward section, the retainer arm being opposed to the base, wherein the rear handle portion of the retainer arm is pivotally connected to the rear handle portion of the base so that the retainer arm can pivot from an open position for the plurality of projections to receive hair and a closed position for retaining hair in the plurality of projections, the forward section of the retainer arm not having projections and having sufficient open space that at least 50% of the hair being styled in the plurality of projections is visible to a user; b) placing hair between the forward styling portion of the base and the forward section of the retainer arm with the retainer arm in its open position; c) moving the retainer arm to the closed position; and d) drawing the device through hair thereby styling the hair.

In another embodiment of the present invention, there is provided a hair styling device comprising: a) a base comprising a rear handle portion and a forward styling portion comprising a plurality of projections for hair styling; and b) a retainer arm comprising a rear handle portion and a forward section comprising a single elongated arm that is disposed between the projections when the retainer arm is in the closed position, such that the projections project upwardly around the single elongated arm; the retainer arm being opposed to the base, wherein the rear handle portion of the retainer arm is pivotally connected to the rear handle portion of the base so that the retainer arm can pivot from an open position for the plurality of projections to receive hair and a closed position for retaining hair in the plurality of projections, the forward section of the retainer arm not having projections and having sufficient open space that at least 50% of the hair being styled in the plurality of projections is visible to a user.

In another embodiment of the present invention, there is provided a hair styling device comprising: a) a base comprising a rear handle portion and a forward styling portion, the forward styling portion comprising a plurality of projections for hair styling; and b) a retainer arm comprising a rear handle portion and a forward section comprising at least two separate arms that do not form an open loop, the retainer arm being opposed to the base, wherein the rear handle portion of the retainer arm is pivotally connected to the rear handle portion of the base so that the retainer arm can pivot from an open position for the plurality of projections to receive hair and a closed position for retaining hair in the plurality of projections, the forward section of the retainer arm not having projections and having sufficient open space that at least 50% of the hair being styled in the plurality of projections is visible to a user. In one embodiment, the at least two arms each comprise a proximate portion coupled to the rear handle portion of the retainer arm, and a distal portion that is structurally independent of each other and not coupled to any other structure. In one embodiment, when the retainer arm is in the closed position, the projections project upwardly between the at least two arms. In one embodiment, when the retainer is in the closed position, the projections project upwardly both between and around the at least two arms. In one embodiment, the forward styling section of the base is oval shaped in plan view, and the distal portions of the at least two arms are curved. In one embodiment, the forward styling section of the base is rectangle shaped in plan view, and the distal portions of the at least two arms are substantially straight.

DRAWINGS

These and other features, aspects and advantages of the invention will be more apparent from the following description and accompanying drawings where:

DESCRIPTION

Figure 1:
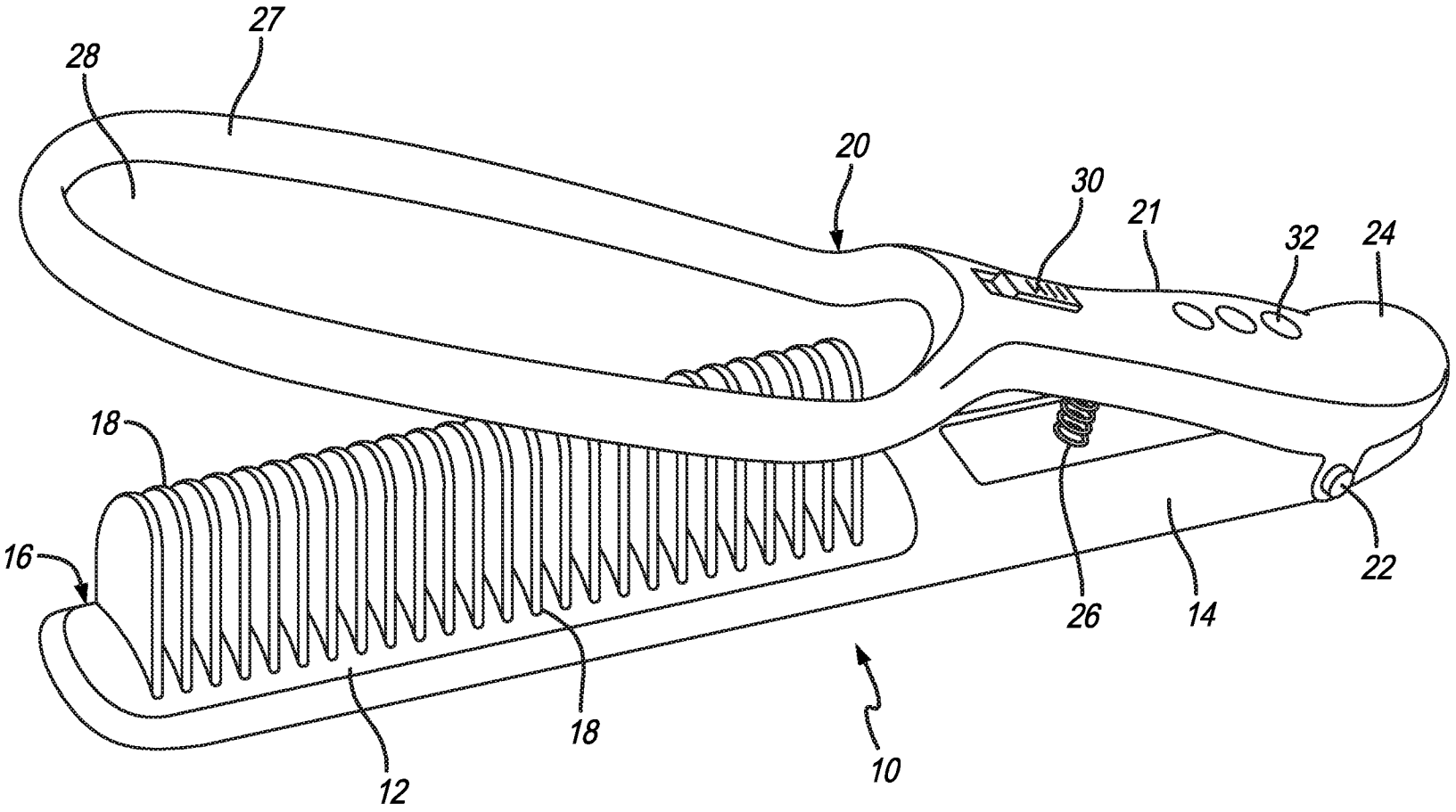
FIG. 1 is a perspective view of a comb-like device having features of the present invention, being in an open position.

With regard to FIG. 1, a comb-like device 10 having features of the present invention comprises a base 12 having a rear handle portion 14 and a forward styling portion 16, the forward styling portion 16 having a plurality of plate like projections 18 spaced apart from each other and substantially parallel to each other in a projection field 44. The projections 18 can be about to about 5 mm thick, about 1 mm to about 5 mm wide adjacent to the base, about 5 mm to about 15 mm tall, and spaced apart by about 1 mm to about 5 mm. The projections 18 can either be heated or not heated. If heat is desired, the projections 18 are heated by an energy source such as a cord 56 connected to A/C power (see FIGS. 7-9) or a battery (not shown).

Figure 2:
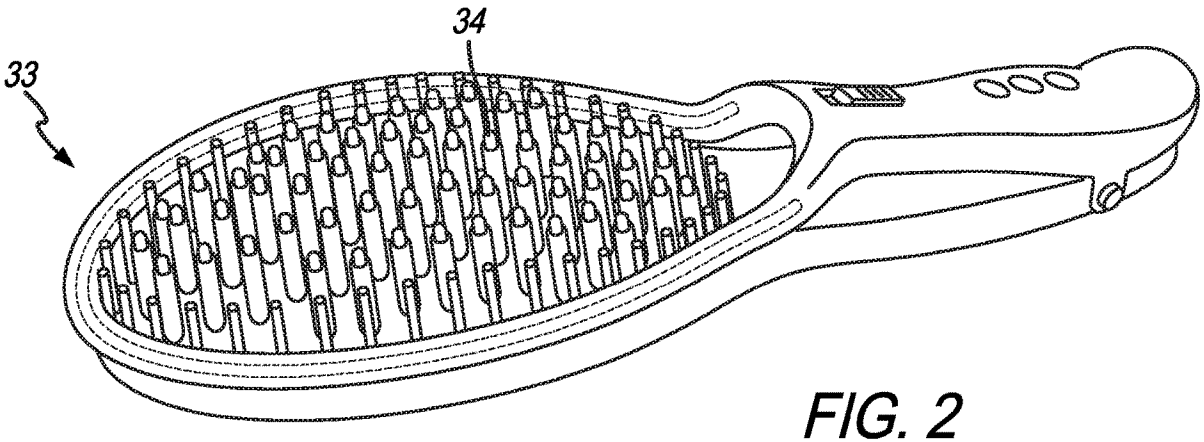
FIG. 2 is a perspective view of a brush-type device according to the present invention being in a closed position.

A retainer arm 20 comprises a rear handle portion 21 and a forward styling portion 27. The rear handle portion 21 is pivotally connected such as by pivot pins 22 to a rear end portion 24 of the handle portion 14 so that the retainer arm 20 can pivot between an open position as shown in FIG. 1, and with regard to a brush-type version of the present invention, a closed position as shown in FIG. 2. The retainer arm 20 is biased to its open position by biasing means such as a spring 26 or other conventional biasing means, such as a memory plastic element or a pneumatic piston.

The retainer does not have bristles or teeth and has sufficient open space that more than half (50%), and preferably substantially all, of the hair being styled in the brush or comb is visible to a user through the retainer so that a user can see the user's hair while styling to optimize styling and not over heat hair.

Figure 3:
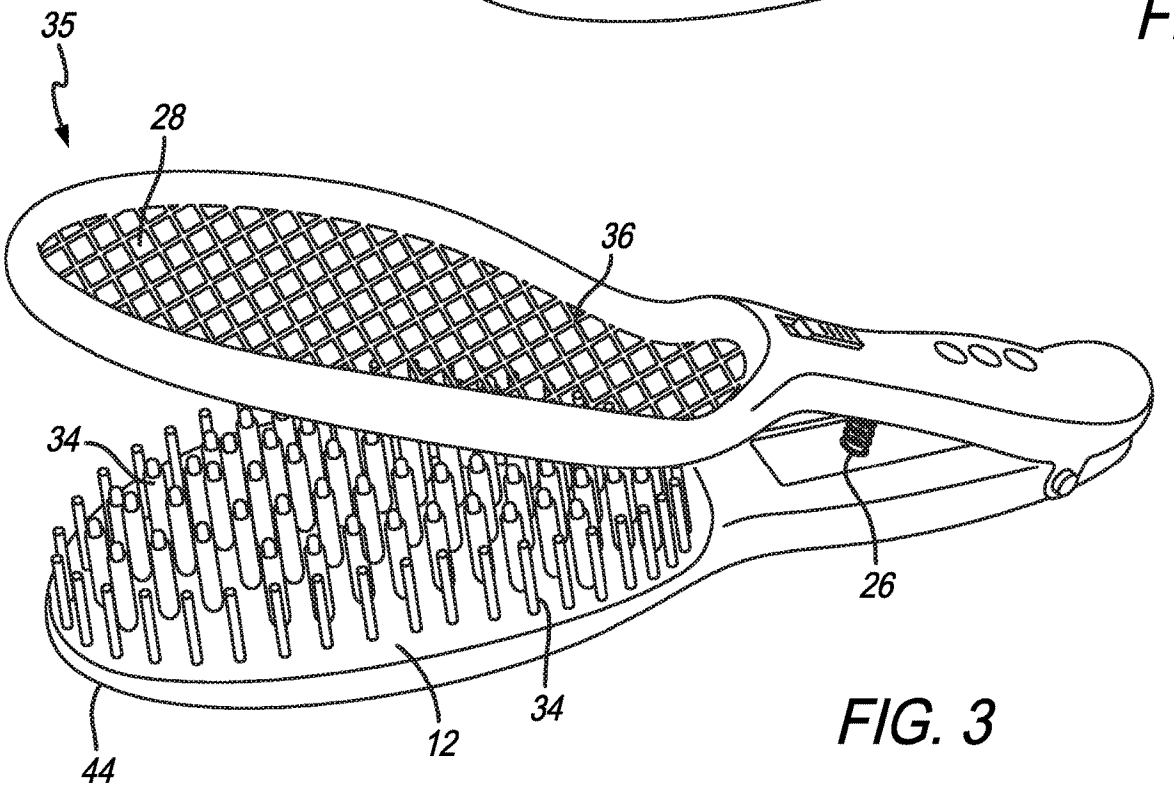
FIG. 3 is another version of a brush-like structure having features of the present invention in an open position.

In one embodiment, as shown in FIGS. 1-3, the forward section 27 of the retainer arm 20 comprises an open loop 28 that surrounds the projections 18 in the projection field 44, with the projections 18 able to project upwardly through the loop 28, in a manner similar to that shown in FIG. 2. Thus, as shown in FIG. 2, the loop 28 in the closed position is circumferentially around substantially all of the projections 18 in the projection field 44. Optionally, in the closed position, the loop 28 is disposed within the projection field 44 such that the projections 18 project upwardly both within and outside of the loop 28.

Figure 4A:
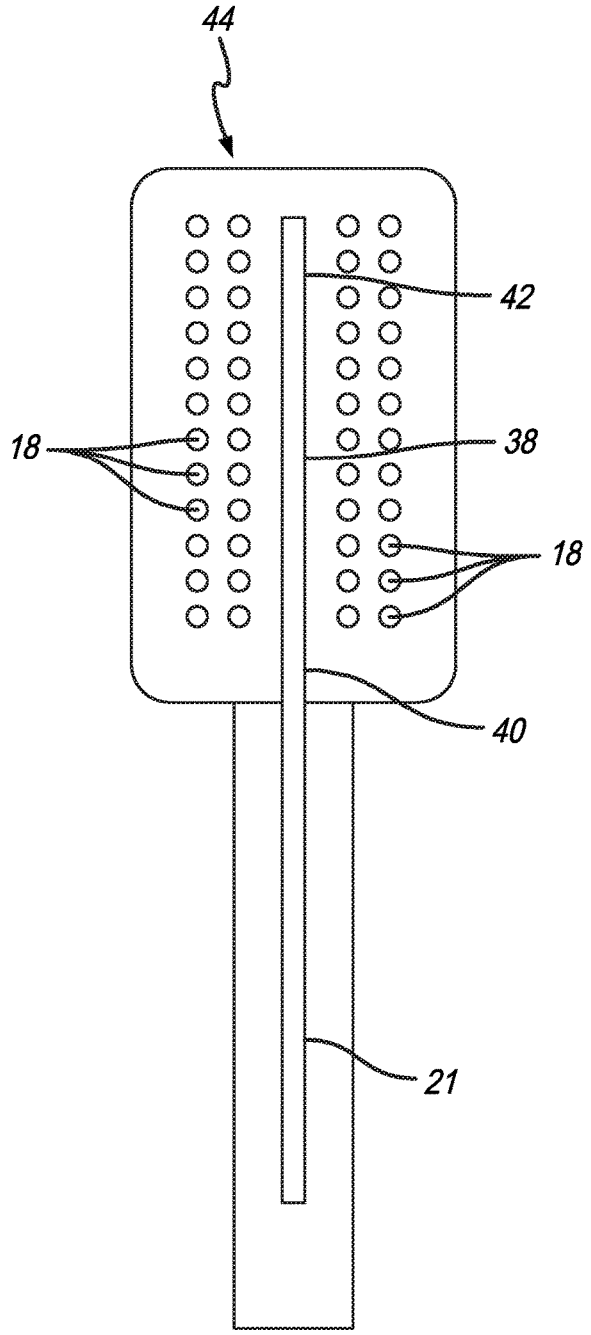
FIG. 4A is a top plan view of a brush-like structure having features of the present invention in a closed position, wherein the forward styling portion of the retainer arm comprises a single arm, and it is disposed within a base that is rectangular in shape.
Figure 4B:
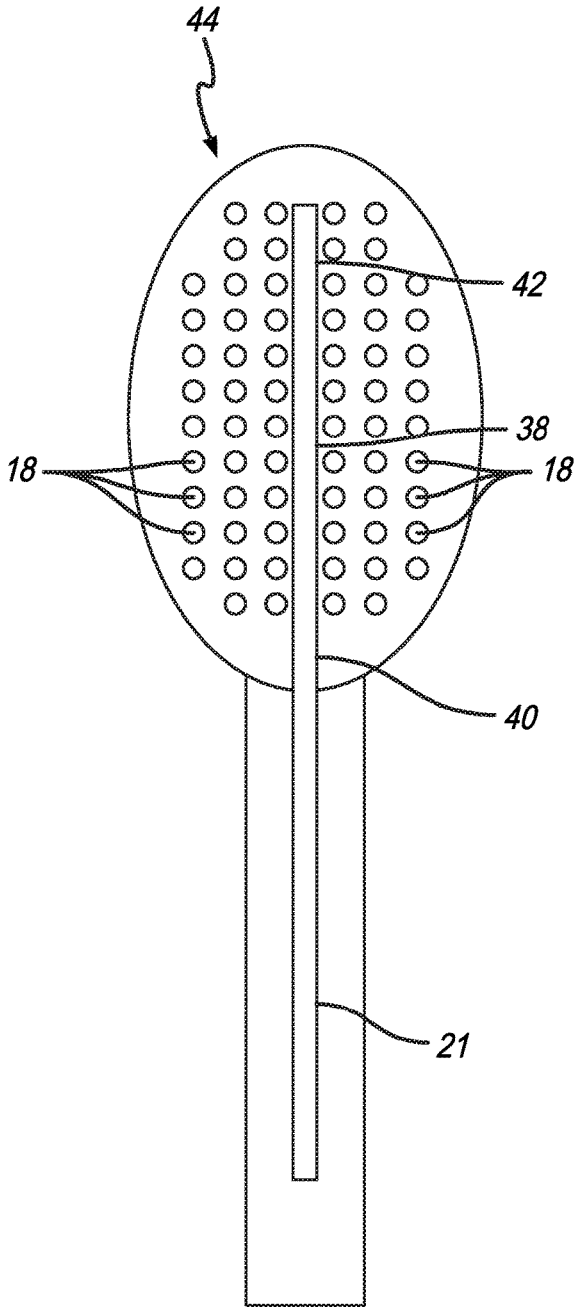
FIG. 4B is a top plan view of a brush-like structure having features of the present invention in a closed position, wherein the forward styling portion of the retainer arm comprises a single arm and it is disposed within a base that is oval in shape.

As shown in FIGS. 4A and 4B, the forward section of the retainer arm 20 can comprise a single, non-looped, elongated arm 38. The arm 38 comprises a proximate portion 40 and a distal portion 42. The proximate portion 40 of the arm 38 is coupled to the rear handle portion 21 of the retainer arm 20. The distal portion 40 of the arm 38 preferably extends through the projections 18 to the distal end of the projection field 44, that is, the projections most distant from the handle portion 21. When in the closed position, the single arm 38 is disposed within the projection field 44, at any location therein, such that the projections 18 project upwardly around the single arm 38.

Figure 5A:
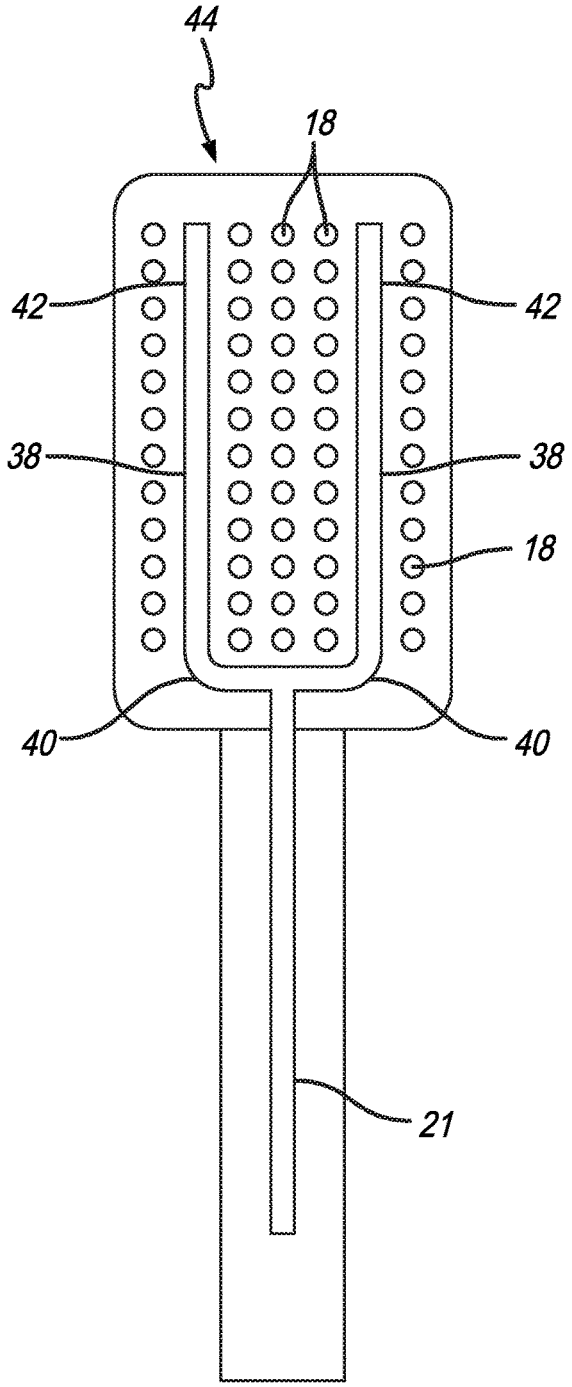
FIG. 5A is a top plan view of a brush-like structure having features of the present invention in a closed position, wherein the forward styling portion of the retainer arm comprises two arms and they are disposed within the projection field on base that is in the shape of a rectangle.
Figure 5B:
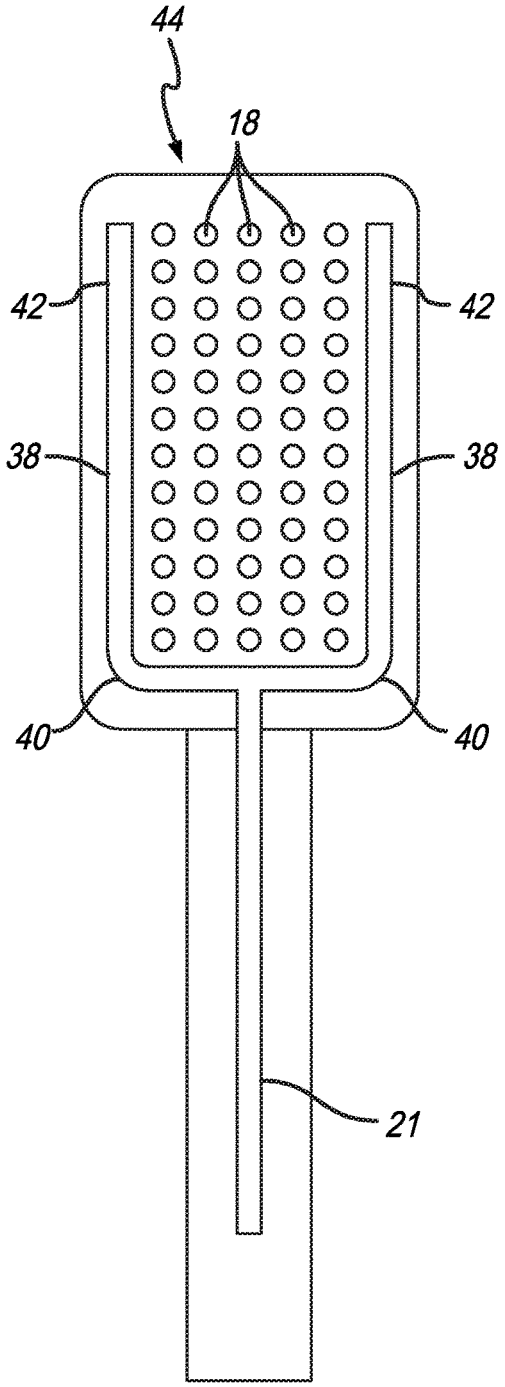
FIG. 5B is a top plan view of a brush-like structure having features of the present invention in the closed position, wherein the forward styling portion of the retainer arm comprises two arms and they are disposed along the perimeter of the projection field on a base that is in the shape of a rectangle.
Figure 6A:
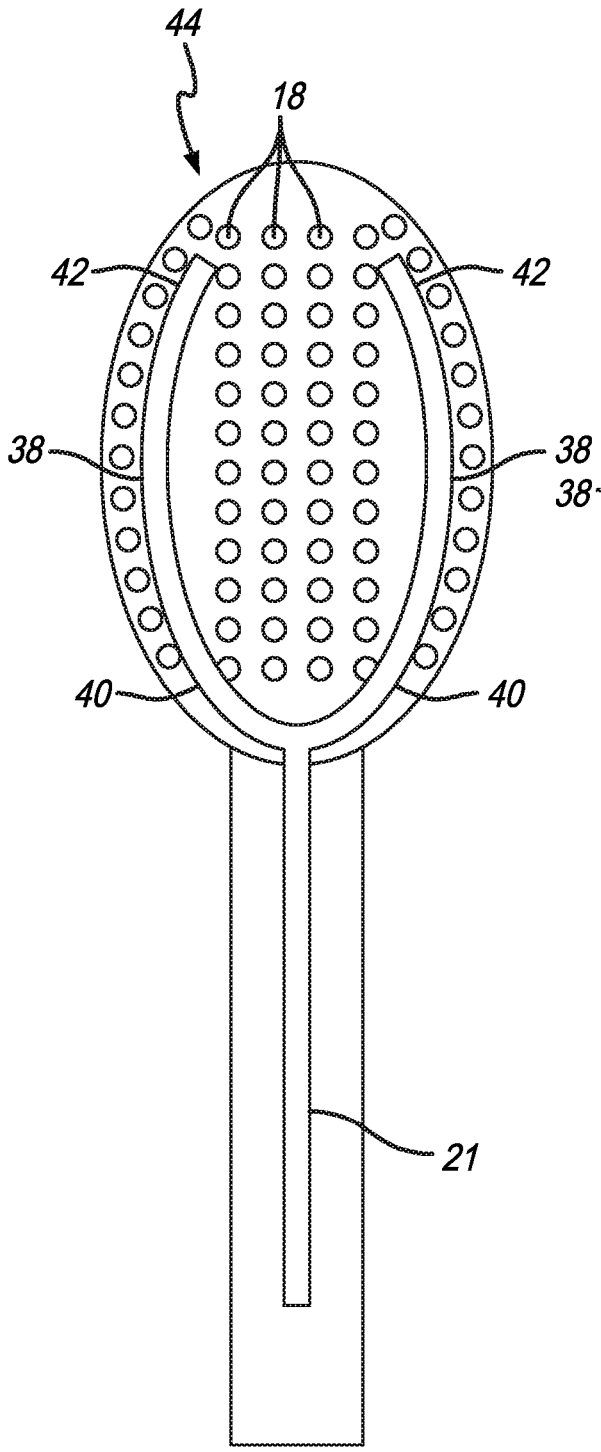
FIG. 6A is a top plan view of a brush-like structure having features of the present invention in the closed position, wherein the forward styling portion of the retainer arm comprises two arms and they are disposed within the projection field on a base that is in the shape of an oval.
Figure 6B:
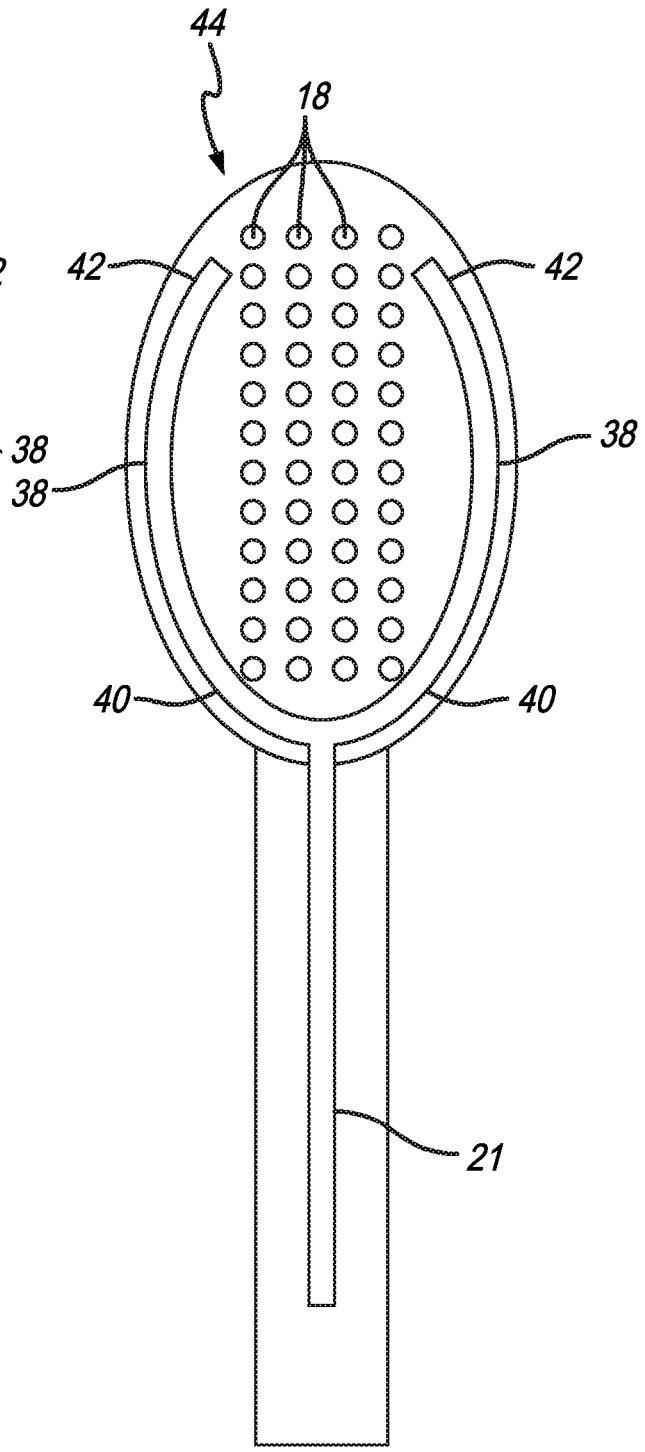
FIG. 6B is a top plan view of a brush-like structure having features of the present invention in the closed position, wherein the forward styling portion of the retainer arm comprises two arms and they are disposed along the perimeter of the projection field on a base that is in the shape of an oval.

As shown in FIGS. 5-6, the forward section 27 of the retainer arm 20 can comprise at least two separate arms 38 and the two arms 38 do not form an open loop. The proximate portion 40 of each arm 38 is coupled to the rear handle portion 21 of the retainer arm 20, and the distal portions 42 of the two arms 38 are structurally independent of each other and are not coupled to any other structure. In one version, as shown in FIGS. 5A and 5B, the two separate arms 38 project away from the rear handle portion 21 of the retainer arm 20 in the shape of a "U," and in another version as shown in FIGS. 6A and 6B, the two separate arms 38 are in the shape of an open oval. Optionally, the forward section 27 of the retainer arm 20 comprises more than two arms, for example three or four arms.

As shown in FIGS. 5-6, when in the closed position, there are two different ways that the at least two arms 38 are disposed relative to the projection field 44. As shown in FIGS. 5B and 6B, the two arms 38 are disposed outside of the projection field 44, wherein the projections 18 only project upwardly between the two arms 38. As shown in FIGS. 5A and 6A, the two arms 38 are disposed within the projection field 44, at any location within the projection field 44, such that the projections 18 project upwardly both between and outside of both arms 38.

The rear handle portion 24 of the retainer arm 20 is provided with a switch 30 for turning the power on and off for heating the projections 18. Indicator lights 32 such as LEDs can be used for indicating the temperature of the projections 18.

The projections 18 can be a variety of shapes. Rather than the plate-like projections 18 shown in FIG. 1, a device 33 according to the present invention 10 can be provided with a plurality of cylindrical bristle-like projections 34 as shown in FIG. 2. The projections 34 can be from about 1 mm to about 15 mm tall and about 1 mm to about 5 mm in diameter.

Optionally, in a device 35 shown in FIG. 3, the loop 28 can be provided with a mesh-like structure 36 as shown in FIG. 3, where the holes in the mesh are sized so that the projections 34 can project through the mesh openings. The two arms 38 can also be provided with a mesh-like structure, where the holes in the mesh are sized so that the projections 18 can project through the mesh openings.

Figure 7:
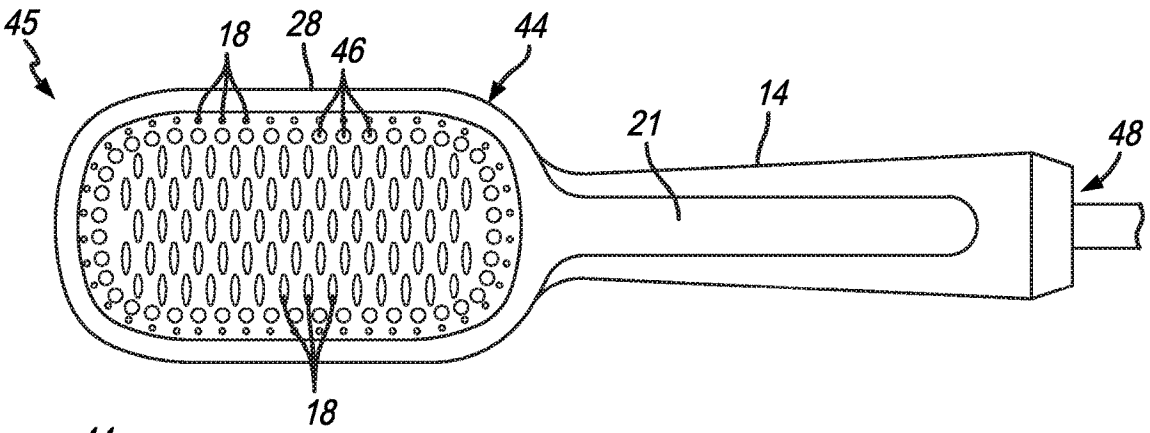
FIG. 7 is a top plan view of a brush-like structure having features of the present invention in the closed position, wherein the air-outlet holes can be seen.
Figure 8:
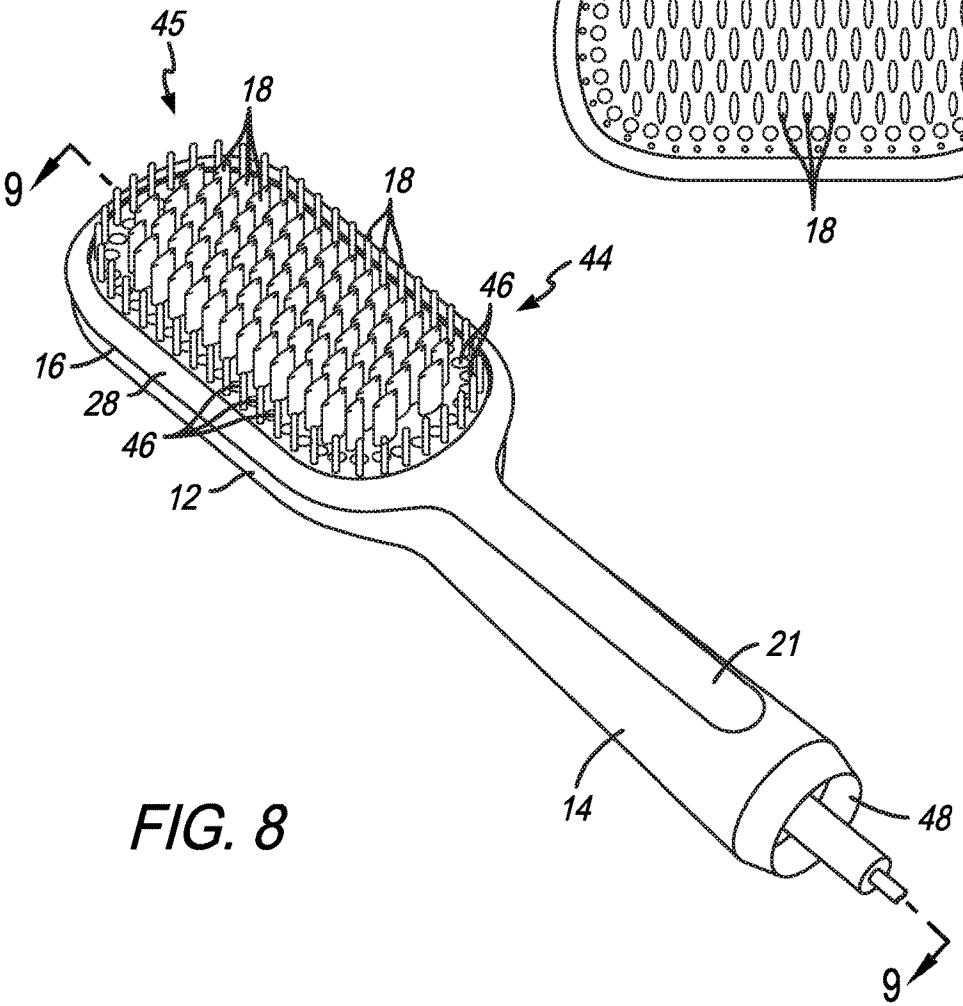
FIG. 8 is a perspective view of the brush-like structure of FIG. 7.

Additionally, in a device 45 shown in FIGS. 7 and 8, the projections 18 can be a combination of shapes. For example, the brush-like structure can comprise plate-like projections 18 in the center, and thinner cylindrical bristle-like projections 18 around the perimeter of the projection field 44. However, the projections 18 can be in any combination of shapes, in any pattern.

Also, as shown in FIGS. 7 and 8, the device 45 can further comprise a plurality of holes 46 or openings disposed in the forward styling portion 16 of the base 12 through which air can be blown onto and/or through the hair being styled. The plurality of holes 46 can either be dispersed throughout the projection field 44, or around the perimeter of the projection field 44, as shown in FIGS. 7 and 8. The plurality of holes 46 can be between and/or in close proximity to the projections 18. The device 45 can also comprise an air intake opening 48. The air intake opening 48 can be located anywhere on the device 10, but preferably the air intake opening 48 is disposed at the rear handle portion 14 of the base 12, such that it will not be proximate the area where hair is being styled.

Figure 9:
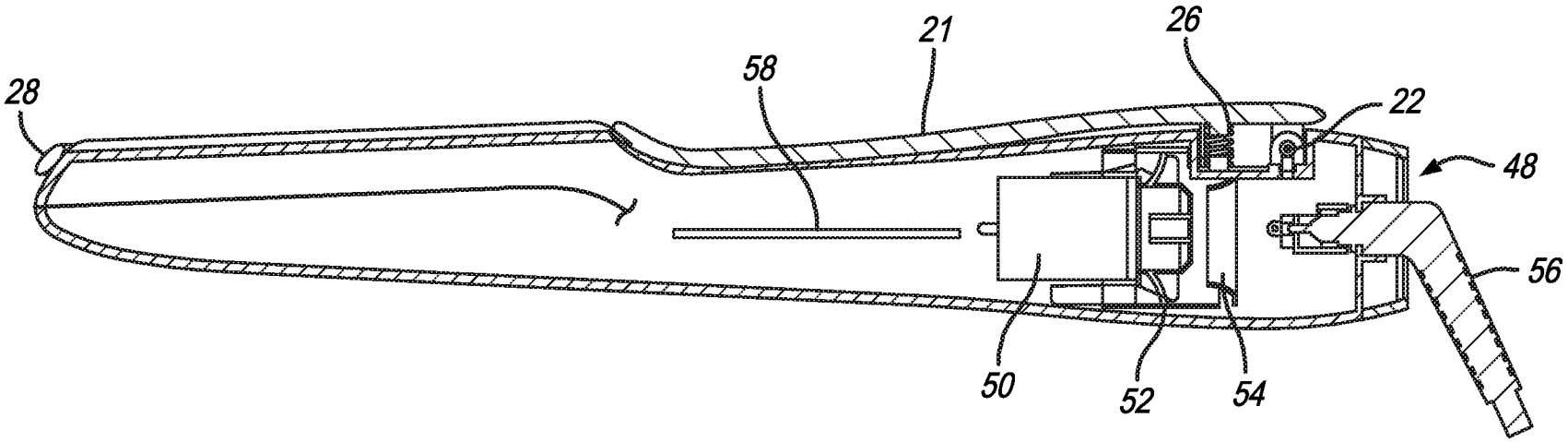
FIG. 9 is a sectional view of the brush-like structure of FIG. 8, taken along line 9-9 in FIG. 8.

As shown in FIG. 9, the device 45 can further comprise one or more motors 50 for powering one or more blowers 52 for blowing air through the plurality of holes 46 or openings. The one or more motors 50 and the one or more blowers 52 can be located anywhere in the rear handle portion 14 or the forward styling portion 16 of the base 12. Optionally, as shown in FIG. 9, the device 45 can comprise an air guide ring 54 for guiding air through the air intake opening 48 and out through the plurality of holes 46.

Optionally, as shown in FIG. 9, air blown by the blowers 52 through the plurality of holes 46 can be heated by one or more heaters 58. The one or more heaters 58 can be located anywhere in the rear handle portion 14 or the forward styling portion 16 of the base 12.

The device 10 can be made of plastic material, metals, and other materials typically used for hair styling devices. The bristles, plates or teeth can be heated by making them out of metal, having and placing them in thermal contact with heated base 12. The heating element for heating the projections 18 can be an inner core portion so the projections 18 can be formed of metal with an end or base of each projection 18 in thermal contact with the inner core. More information regarding this can be found in U.S. Pat. Nos. 4,593,708 and 4,625,738.

Referring now to FIGS. 10-13, there is shown an additional embodiment of a hair styling device 100 of the present invention. The hair styling device 100, like that of FIGS. 7-9, comprises the base 12 and the retainer arm 20. The base 12 has the rear handle portion 14 and the forward styling portion 16, and the retainer arm 20 has the rear handle portion 21 and the forward styling portion 27.

Figure 13:
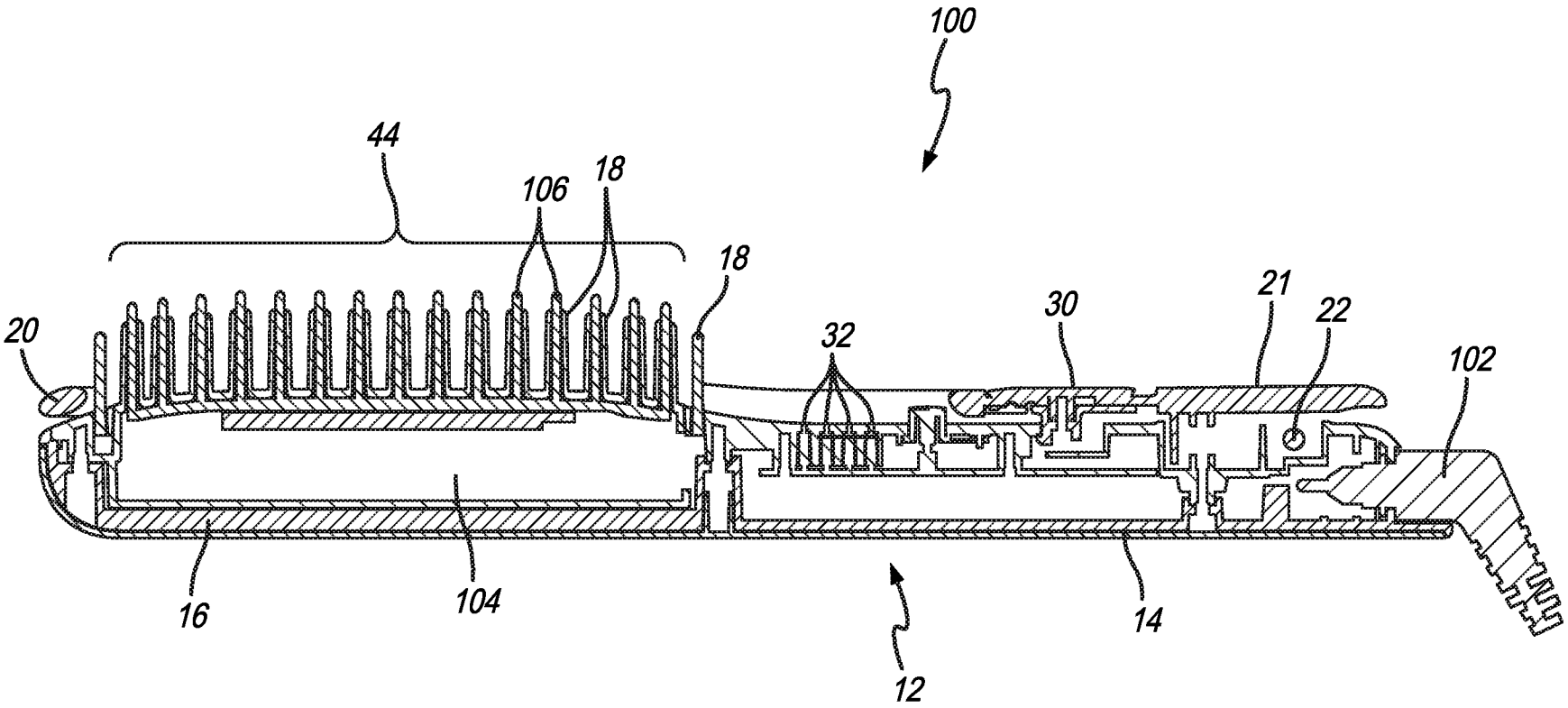
FIG. 13 is a sectional view of the hair styling device of FIG. 10, taken along line 13-13 in FIG. 10.

The device 100 also comprises the plurality of projections 18, similar to those shown in FIGS. 7 and 8. The projections 18 can either be heated or not heated. If heat is desired, the projections 18 are heated by an energy source such as a cord 102 connected to A/C power or a battery (not shown). As best seen in FIG. 13, a heating element 104 is disposed in the base 12 for heating the projections 18.

As shown in FIGS. 10-13, the projections 18 can further comprise a non-heated end cap 106 which protects a user from causing harm to their head by unintentional contact between their head and the heated projections 18.

The rear handle portion 21 of the retainer arm 20 is provided with a switch 30 for turning the power on and off for heating the projections 18. Indicator lights 32 such as LEDs can be used for indicating the temperature of the projections 18, and as shown in FIGS. 10 and 13 can be disposed along the base 12, rather than the retainer arm 20 as shown in FIGS. 1-3.

Figure 10:
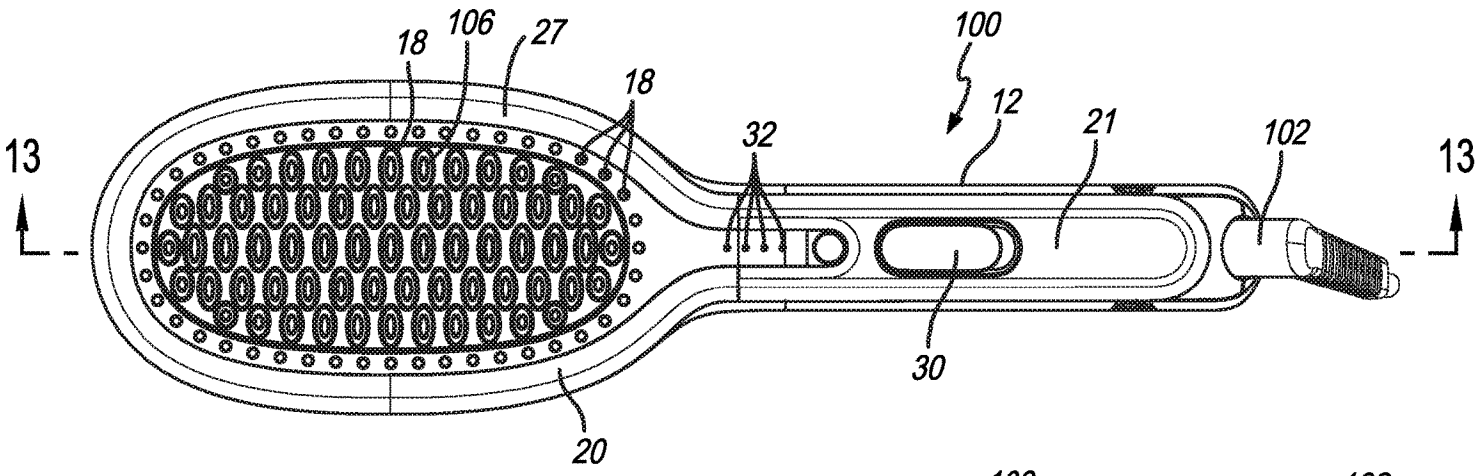
FIG. 10 is top plan view of an additional embodiment hair styling device of the present invention.
Figure 11:
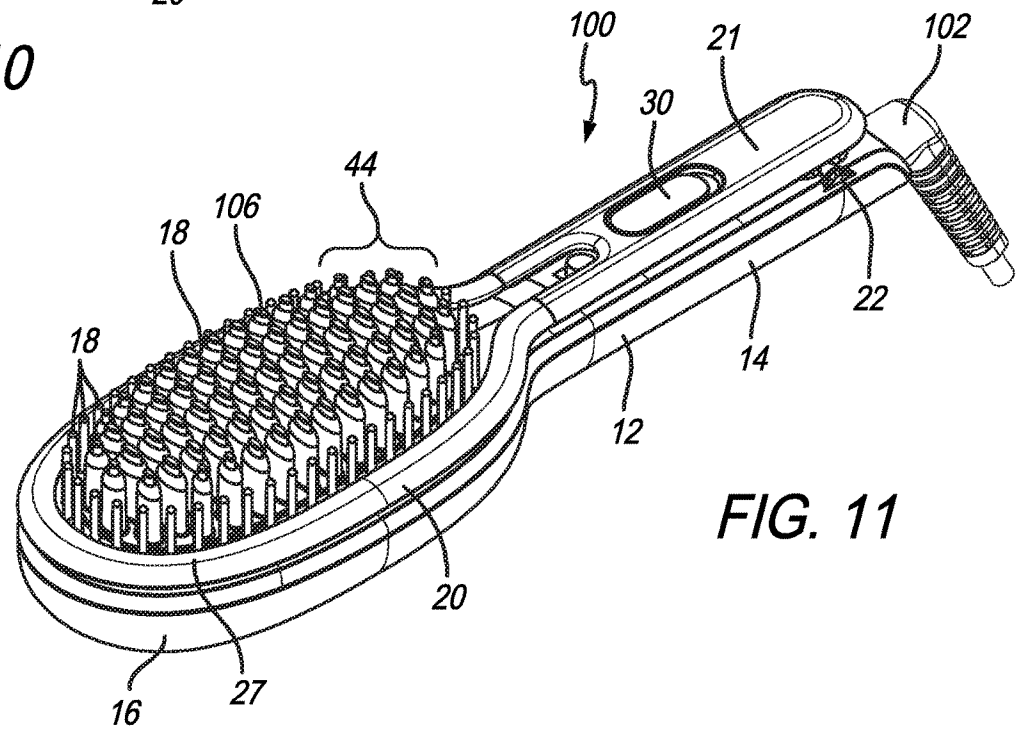
FIG. 11 is a perspective of the hair styling device of FIG. 10.
Figure 12:
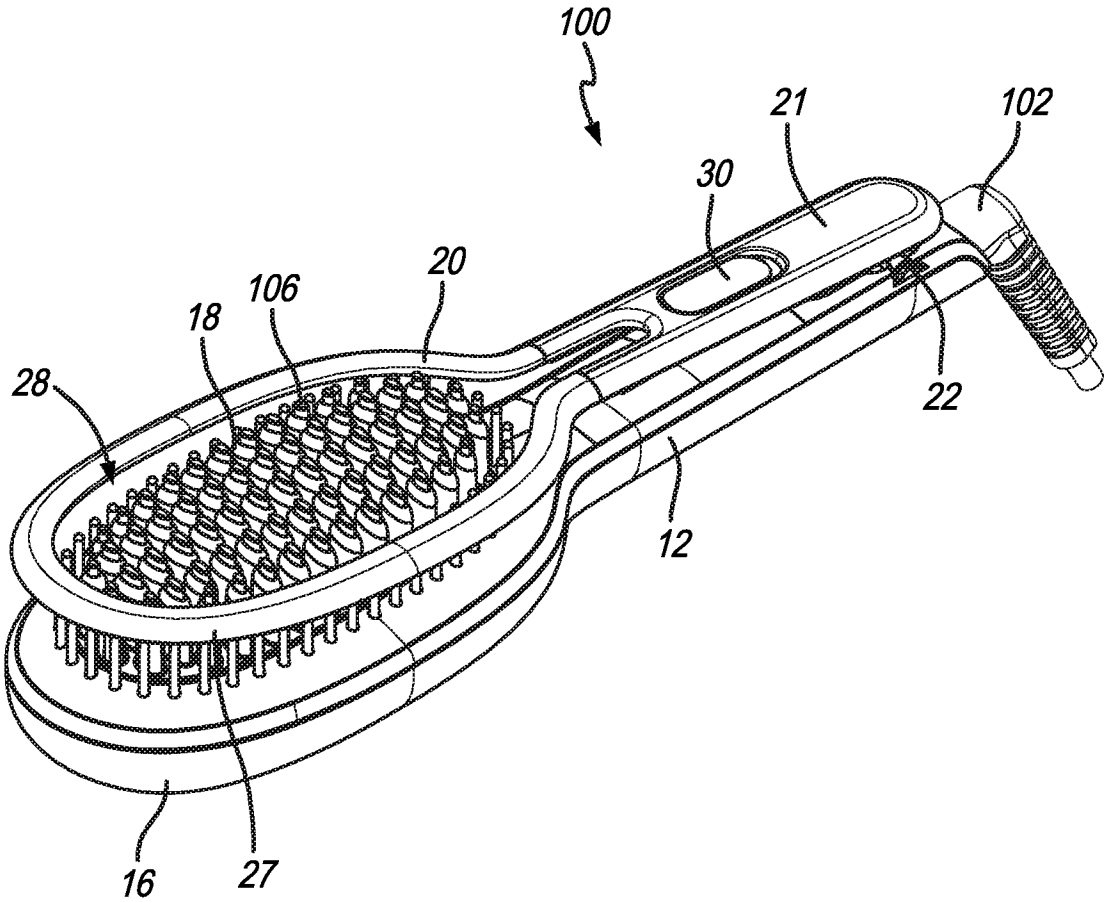
FIG. 12 is the same view as FIG. 11, wherein the retainer arm is in the open position.

As shown in FIG. 10, the indicator lights are positioned on the rear handle portion of the base and are encircled by the forward section of the retainer arm when the retainer arm is in the closed position, such that the indicator lights are viewable through the forward section of the retainer arm.

In use of the device 10, 45, 100 according to the present invention, a user places hair between the forward styling portion 16 of the base 12 and the forward styling portion 27 of the retainer arm 20, with the retainer arm 20 in its open position. Optionally the projections 18 are heated. It is not necessary according to the present invention that they be heated, but it is preferred. The user then moves the retainer arm 20 to the closed position and draws the device 10, 45, 100 through hair thereby styling the hair. This can be performed with a single hand, and thus there is no risk of awkwardness associated with using two hands and the risk of scalding the hand used for holding the hair in place during styling is eliminated.

An advantage of the invention is the ability to use the device with a single hand, thus reducing the risk of scalding or burning of the user. In addition, the hair is visible through the loop or two arms, even when mesh is used, so that a user can observe the hair while styling. For example, the heat feature can be used for drying damp hair, a user can, with visual indications, move hair through the device at an appropriate speed to dry the hair without risk of overheating the hair. Preferably, at least 50%, and more preferably substantially all, of the hair being styled is visible to the user. Thus, this invention provides a heated hair curling device with improved safety.

Although the present invention has been described in considerable detail with reference to certain preferred versions thereof, other versions are possible. Therefore the spirit and scope of the appended claims should not be limited to the description of the preferred versions contained herein.

All features disclosed may be replaced by other features, and all the features need not be included in an embodiment of the invention or combined as described and shown.

What is claimed is:

1. A hair styling device comprising:

a base comprising a rear handle portion and a forward styling portion, the forward styling portion substantially oval in shape and comprising a plurality of projections for hair styling, the plurality of projections comprising a plurality of first shaped projections encircling a plurality of second shaped projections on the base, the rear handle portion further comprising at least one temperature status visual indicator; and a retainer arm comprising electronic controls for the hair styling device and further comprising a rear handle segment and a forward section substantially oval in shape, the retainer arm being opposed to the base, wherein the rear handle segment of the retainer arm is pivotally connected to the rear handle portion of the base so that the retainer arm can pivot from an open position for the plurality of projections to receive hair and a closed position for retaining hair in the plurality of projections, the forward section of the retainer arm not having projections;

wherein the plurality of projections are located on a projection surface region of the forward styling portion and when the retainer arm is in the closed position, the retainer arm encircles the projection surface region, every one of the plurality of projections, and the at least one temperature status visual indicator, and no projections provided on the hair styling device are located outside a rounded encircling periphery of the retainer arm when the retainer arm is in the closed position;

wherein a user closing the retainer arm secures hair between the retainer arm and the base and between a portion of the plurality of first shaped projections and the plurality of second shaped projections such that the user can draw the hair styling device through the hair using one hand, and further wherein the at least one temperature status visual indicator on the base is viewable through the forward section of the retainer arm.

2. The device of claim 1, wherein at least some of the plurality of projections are heated.

3. The device of claim 1, further comprising:

a plurality of holes disposed in the forward styling portion of the base, wherein the plurality of holes is dispersed throughout the plurality of projections;

one or more blowers for blowing air through the plurality of holes;

one or more motors for powering the one or more blowers; and one or more heaters for heating air blown by the one or more blowers.

4. The device of claim 1, wherein the forward section of the retainer arm has sufficient open space such that hair being styled is visible to the user.

5. The device of claim 1, wherein the forward section of the retainer arm comprises mesh.

6. The device of claim 1, wherein the forward section of the retainer arm is a loop and the loop in the closed position is circumferentially around all of the projections.

7. A hair styling device comprising:

a base comprising a rear handle portion and a forward styling portion, the forward styling portion substantially oval in shape and comprising a plurality of projections for hair styling, the plurality of projections comprising a plurality of first shaped projections encircling a plurality of second shaped projections, the rear handle portion further comprising at least one temperature status visual indicator; and a retainer arm comprising electronic controls for the hair styling device and further comprising a rear handle segment and a forward section substantially oval in shape, wherein the rear handle segment of the retainer arm is pivotable from an open position for the plurality of projections to receive hair and a closed position for retaining hair in the plurality of projections, the forward section of the retainer arm free of projections and comprising open space;

wherein when the retainer arm is in the closed position, the retainer arm encircles collectively all of the plurality of projections provided on the forward styling portion and the at least one temperature status visual indicator, and no projections provided on the hair styling device are located outside a rounded encircling periphery of the retainer arm when the retainer arm is in the closed position;

wherein a user closing the retainer arm secures hair between the retainer arm and the base and between a portion of the plurality of first shaped projections and the plurality of second shaped projections such that the user can draw the hair styling device through the hair using one hand, and further wherein the at least one temperature status visual indicator on the base is viewable through the forward section of the retainer arm.

8. A hair styling device comprising:

a base comprising a rear handle portion and a forward styling portion substantially oval in shape and comprising a plurality of hair styling projections, the base comprising a plurality of first projections having a first shape encircling a plurality of second projections having a second shape, the rear handle portion further comprising at least one temperature status visual indicator; and a retainer arm comprising electronic controls for the hair styling device and further comprising a rear handle segment and a forward section substantially oval in shape, wherein the rear handle segment of the retainer arm is pivotable from an open position for the plurality of hair styling projections to receive hair and a closed position for retaining hair in the plurality of hair styling projections, the forward section of the retainer arm free of hair styling projections;

wherein when the retainer arm is in the closed position, the retainer arm encircles collectively all of the plurality of hair styling projections provided on the forward styling portion and the at least one temperature status visual indicator, and no projections provided on the hair styling device are located outside a rounded encircling periphery of the retainer arm when the retainer arm is in the closed position;

wherein a user closing the retainer arm secures hair between the retainer arm and the base and between a portion of the plurality of first shaped projections and the plurality of second shaped projections such that the user can draw the hair styling device through the hair using one hand, and further wherein the at least one temperature status visual indicator on the base is viewable through the forward section of the retainer arm.

9. The device of claim 7, wherein at least some of the plurality of projections are heated.

10. The device of claim 7, further comprising:

a plurality of holes disposed in the forward styling portion of the base, wherein the plurality of holes is dispersed throughout the plurality of projections;

one or more blowers for blowing air through the plurality of holes;

one or more motors for powering the one or more blowers; and one or more heaters for heating air blown by the one or more blowers.

11. The device of claim 7, wherein the forward section of the retainer arm has sufficient open space such that hair being styled is visible to the user.

12. The device of claim 8, wherein the forward section of the retainer arm has sufficient open space that hair being styled is visible to the user.

13. The device of claim 8, wherein at least some of the plurality of hair styling projections comprise at least one non-heated end cap atop at least one projection.

14. The device of claim 8, further comprising a plurality of holes disposed in the forward styling portion of the base, wherein the plurality of holes is dispersed throughout the plurality of hair styling projections.

15. The device of claim 14, further comprising a blower configured to blow air through the plurality of holes.

16. The device of claim 15, further comprising a motor configured to power the blower.

17. The device of claim 15, further comprising a heater configured to heat air blown by the blower.

18. The device of claim 8, wherein the forward section of the retainer arm is a loop and the loop in the closed position is circumferentially around all of the projections.

19. The device of claim 7, wherein the forward section of the retainer arm is a loop and the loop in the closed position is circumferentially around all of the projections.

* * * * *